United States Patent [19]

Nascher

[11] Patent Number: 4,473,207

[45] Date of Patent: Sep. 25, 1984

[54] PLATE HOLDER

[76] Inventor: Fred Nascher, 10819 Rochester Ave., Los Angeles, Calif. 90024

[21] Appl. No.: 200,443

[22] Filed: Oct. 24, 1980

[51] Int. Cl.[3] ..... A47G 1/16

[52] U.S. Cl. ..... 248/490; 248/488

[58] Field of Search ..... 248/490, 495, 497, 488, 248/441.1; 211/41, 89

[56] References Cited

U.S. PATENT DOCUMENTS

| | | | |
|---|---|---|---|
| 213,264 | 3/1879 | Vizet | 248/490 |
| 921,472 | 5/1909 | Siddall | 248/490 |
| 928,132 | 7/1909 | Kaufman | 248/490 |
| 2,508,841 | 5/1950 | Schreibman | 248/490 |
| 3,263,347 | 8/1966 | McCutcheon | 248/441.1 |
| 3,740,016 | 6/1973 | Buescher | 248/488 |

*Primary Examiner*—William H. Schultz
*Assistant Examiner*—Ramon O. Ramirez
*Attorney, Agent, or Firm*—Ralf H. Siegemund

[57] ABSTRACT

A plate holder for displaying an ornamental plate on a wall surface has three radial arms joined in a common center and spaced at fixed 120° angles from each other to form a rigid planar structure. Each of the arms has a flat rear surface which together define a back plane such that the holder may be hung flat against a wall. The outer end of each of the arms has a plate retaining portion which extends over the rim to secure retain the plate between the arms. At least one of the plate retaining portions is adjustable along a radial direction to permit insertion of the plate within the holder and also to accommodate plates of different diameters.

25 Claims, 11 Drawing Figures

28
29
26
43
30
34
32
14
19
36
62
12a
10
15
50
12c
12b
20
28
29

27
61
28
29
32
34
36
12a
62
63
13
52
19
30
50
22
54
12c
29
28
27

28
29
27
26
35
43
32
12a
37
34
36

12a
11
15
13
20
24a
21b
21a
12b
20'
13
15
50
20"
24b
18
21c
22
23
12a'
12c
24c 54
20
20'
20"
11
52
22
23
50
13

49
62
47
36'
39
41
45
46
60
35
14'

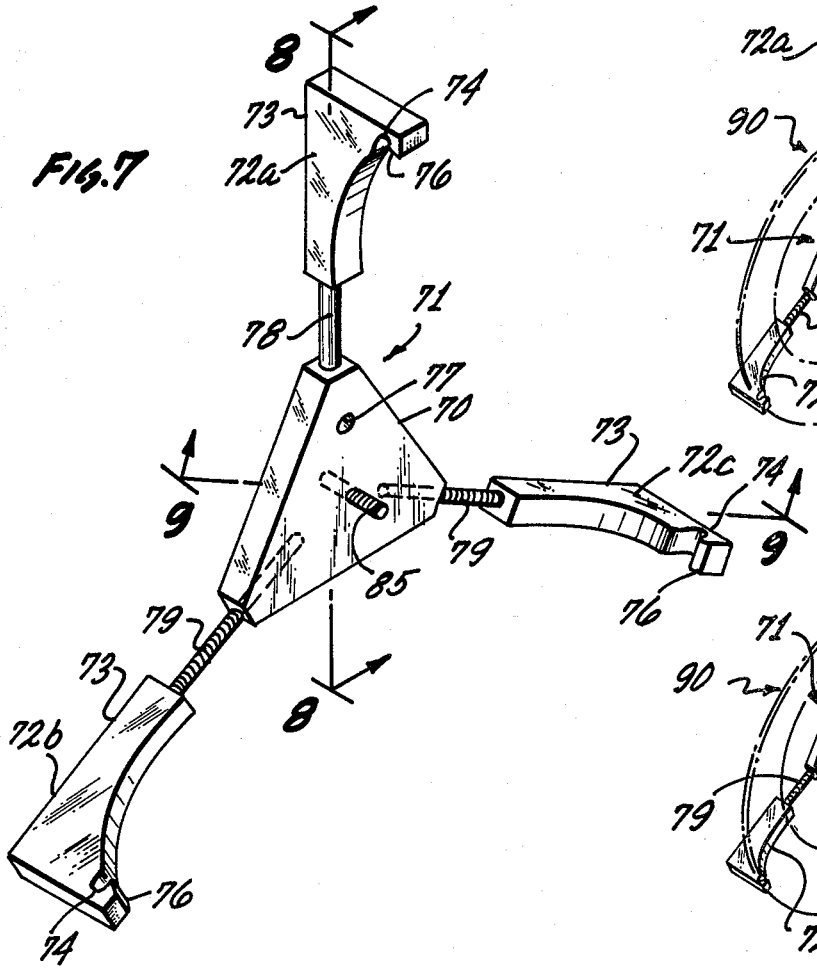
FIG. 7
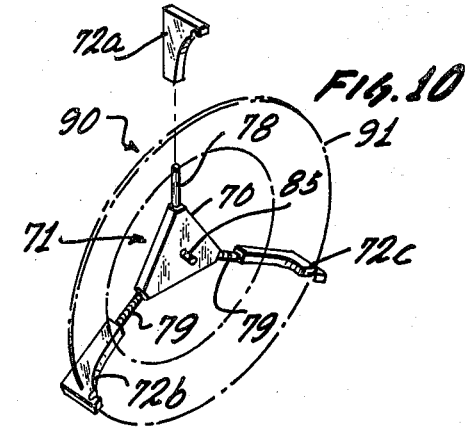
FIG. 10
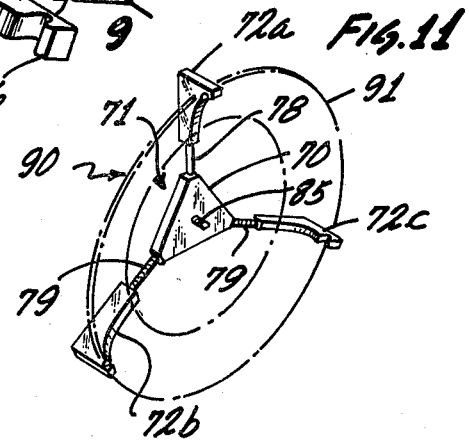
FIG. 11
FIG. 8
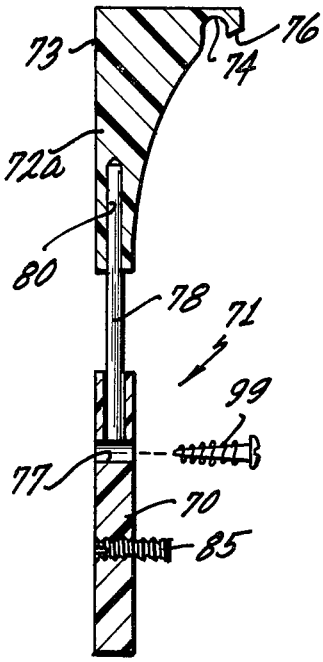
FIG. 9
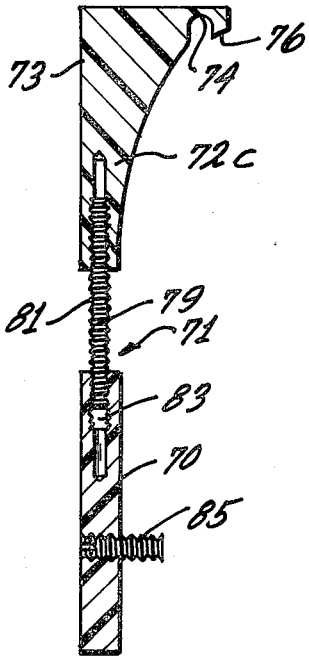

PLATE HOLDER

BACKGROUND OF THE INVENTION

1. Field of the Invention

This invention pertains to the field of plate holders useful for supporting ornamental plates and particularly for displaying such plates or dishes on a wall surface.

2. State of the Prior Art

A variety of plate holders are known in the art. The most pertinent art of which the applicant has knowledge is the wall fixture disclosed in U.S. Pat. No. 2,508,841 issued May 4, 1948 to Schreibman. This reference teaches a plate holder comprising a plurality of intersecting strips retained by a bolt passing therethrough at a point of intersection. The strips are held in a radially spaced relationship by a ring provided with slots through which pass the strips at predetermined intervals. The outer ends of the strip are provided with hooks for retaining the rim of a plate. The strips are not disposed co-planarly along the retaining bolt but instead are stacked one over the other axially along this bolt. The resulting structure is not planar and is therefore not suitable for hanging directly against the wall surface as it will not lie flat thereagainst. To correct for this deficiency the spacer ring supporting the strips is of cylindrical form and serves to space the strips from the wall surface. The entire structure is affixed to a wall by a screw or a nail passing through a perforated metal strip attached to the spacer ring.

SUMMARY OF THE INVENTION

The present invention overcomes the deficiencies of the prior art by providing a novel, rigid planar arm structure which does not require spacer means for supporting the arms, the arms being interconnected otherwise in a radially spaced relationship, nor a spacer for spacing the radial arm structure from a wall surface.

The ornamental plate holder of this invention comprises a plurality of arms provided at their outer ends with plate retaining means constructed for engaging the rim of a plate and have means connected to the inner ends for joining the arms in a planar radial structure at fixed angles to each other. Each arm has at least one particular flat surface such that when the arms are joined in a common center to form the planar radial structure the particular flat surfaces of the arms are retained in a common back plane. The radial distance of one of the plate retaining means is adjustable in relation to the common center and independently of the means for joining the arms.

Also provided are means for adjusting plate retaining portions of the holder for various plate diameters as well as varying depths of the dishes to be held therein.

In a first embodiment of the invention the inner ends of the arms are provided each with a tab member, the tab members being of complementary shape and cooperating to join the arm in a planar rigidly spaced radial structure. The tab members are retained in cooperative relationship by fastener means such as a screw member threaded through the cooperating tab members.

At least one of the arms is constructed for variably extending its length to accomodate plates of various diameters. The plate retaining means have portions extending radially inwardly over the rim of plate for retaining the same against the front of the planar structure, and a spacer preferably projects frontally from said planar structure for urging the plate against the radially inwardly extending portion of the retaining means. The spacer means may be a screw threaded into the back of the planar structure and is preferably coaxial with the fastener means. The spacer means is thus adjustable for abutting against the bottom of a plate for urging the same into engagement with the radially inwardly extending portions of the retaining means.

The arms in the first embodiment are preferably of rectangular cross-section and terminate at their inner ends in a rectangular end face. The tab members are generally planar equilateral geometric figures of reduced thickness relative to the arms and have a number of sides equal to the number of arms. Each tab member is attached to the end face of one of the arms in a staggered manner relative to one another such that the tab members may be stacked in a predetermined sequence to form a substantially solid joint between the arms, with each free side of each tab member abutting the end of one of the non-attached arms.

In a second embodiment the plate holder comprises a generally planar central member or means connected to the inner ends of the arms for interconnecting and joining the arms in a planar rigidly spaced radial structure. One of the arms is disengageable from the central member for insertion of the plate in the holder and is reengageable with said central member after engagement of the plate with the radially inwardly extending portions of the remaining arms, thereby securing the plate within the holder.

When a plate is secured to a wall surface by means of this plate holder, the entire radial structure is hidden from view by the plate itself. The only portions of the holder visible to a viewer located generally frontally of the plate are the plate retaining means engaging the rim of the plate. These can be made of an optically transparent material such as polished plexiglass so that no portion of the plate is hidden from view while at the same time no portion of the holder is readily apparent to a viewer.

Preferably, the plate holder of this invention has three radial arms symmetrically spaced at 120° to each other. It is understood that a greater number of arms may be provided and the spacing there between varied.

It is therefore an object of this invention to provide an ornamental plate holder adapted to lie flat against a wall surface without additional spacer means.

It is another object of this invention to provide an ornamental plate holder having rigidly spaced radial arms without necessity of additional arm support means.

It is another object of this invention to provide an inobtrusive plate holder which is not readily apparent to a viewer of the plate.

Yet another object of this invention is to provide a plate holder which will not hide from view any portion of a plate held therein.

BRIEF DESCRIPTION OF THE DRAWINGS

FIG. 7 is a perspective view of a second embodiment of the plate holder of this invention.

FIG. 8 is a cross-section taken along line 8—8 of FIG. 7 showing the disengageable arm of the plate holder, the fastener screw and the plate spacer screw.

FIG. 9 is a cross-section taken along the line 9—9 of FIG. 7 showing one arm attached by means of a threaded rod to the central member and threaded plate spacer screw.

FIG. 10 shows the plate holder of FIG. 7 with the disengageable arm disengaged therefrom to permit positioning of a dish within the plate holder.

FIG. 11 is a perspective of the plate holder of FIG. 7 showing the disengageable arm in a reengaged position to secure a dish within the plate holder.

DETAILED DESCRIPTION OF THE INVENTION

Figure 1:
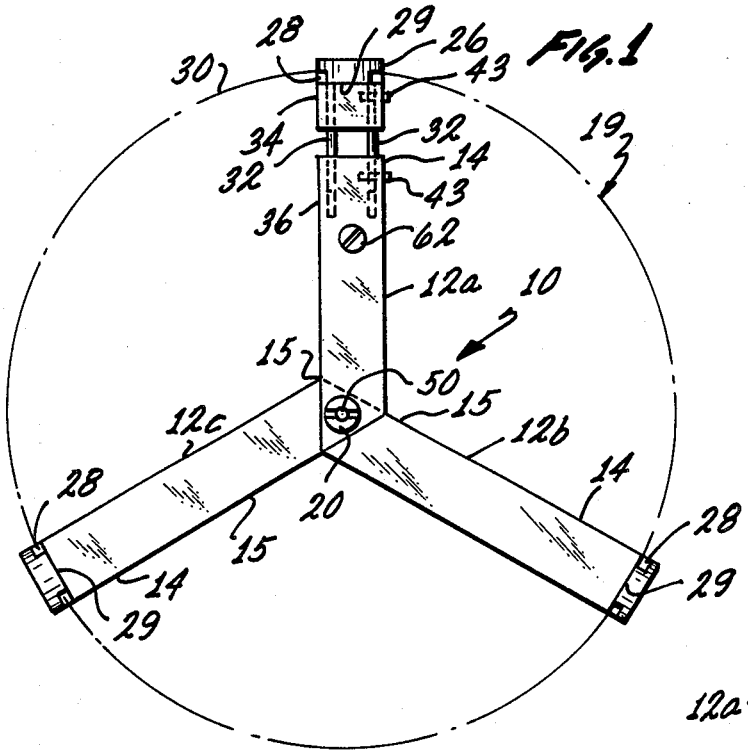
FIG. 1 is a frontal view of a first embodiment of the plate holder showing a dish in dotted lines supported therein.
Figure 4:
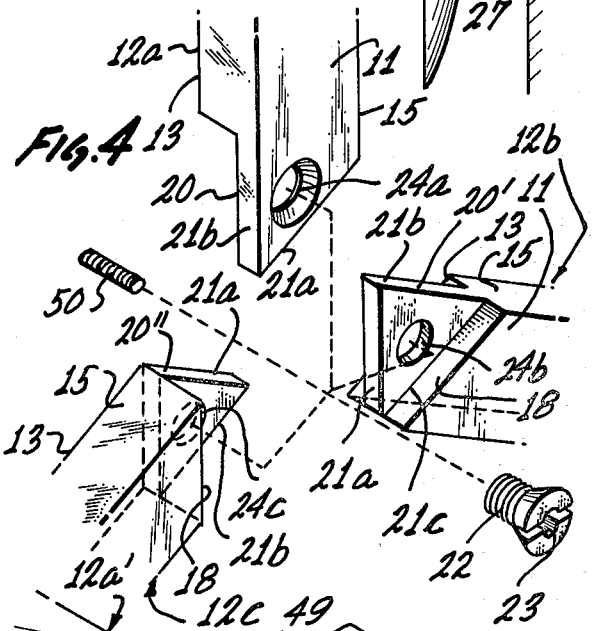
FIG. 4 is a partial exploded view showing the interfitting tab portions of the arms, the fastener screw, and the plate spacer screw of the holder of FIG. 1.

With reference to FIG. 1 of the drawings, the plate holder 10 comprises three arms 12*a, b, c,* each having an outer end 14 and an inner end 15. Preferably the arms are of rectangular cross-section and terminate at their inner ends 15 in a rectangular end face 18 as best seen in FIG. 4, and each arm has at least one flat rear surface 13. Extending from the end faces 18 are tab members 20, 20′ and 20″ respectively which are generally planar equilateral geometric figures of reduced thickness relative to the arms 12*a, b, c,* and have a number of sides equal to the number of arms in the plate holder, e.g. tab 20 has three sides 21*a,* 21*b* and 21*c,* the latter side being attached to the arm 12*a.* Thus in the plate holder of FIG. 1, where three arms 12*a, b, c,* are provided, the tab members 20, 20′, 20″, are equilateral triangles. The tab members 20, 20′, 20″, are of complementary shape and cooperate to join the arms 12*a, b, c,* in a planar rigidly spaced radial structure such that the flat rear surfaces 13 of the arms are retained in a common back plane 52.

Figure 5:
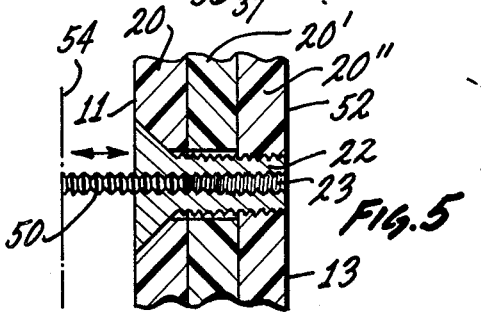
FIG. 5 is a fragmentary elevational crosssection of the plate holder of FIG. 1 showing the fastener screw passing through the interfitting tabs and the plate spacer screw passing through the fastener screw.

The tab members 20, 20′,and 20″, are attached to the end faces 18 in a staggered manner relative to one another as shown in FIG. 4 such that when the arms 12*a, b, c,* are brought into the assembled radial position of FIG. 1, the tab members 20, 20′,and 20″, will be stacked in a predetermined sequence in a common center to form a substantially solid joint illustrated in FIG. 5 with each free side of each tab member abutting the end face 18 of one of the remaining non-attached arms 12*a, b, c.* This way the arms become oriented at fixed angles in relation to each other, being 120° as between any two of the three arms. The tab members are maintained in that fixed cooperative relationship by a fastener such as a threaded screw 22 passing through a bore defined by aligned threaded openings 24(*a*), (*b*) and (*c*) in tab members 20, 20′ and 20″ respectively. The resulting bore preferably extends perpendicularly to the assembled plane or structure. The center of that common bore and of screw 22 then threaded into the bore constitutes the geometric center from which the arms extend. In the embodiment illustrated in FIGS. 1, 2 and 4, the arms 12 are symmetrically spaced from one another at 120° intervals. It will be understood that both the spacing and the number of arms may be varied without departing from the invention.

Figure 2:
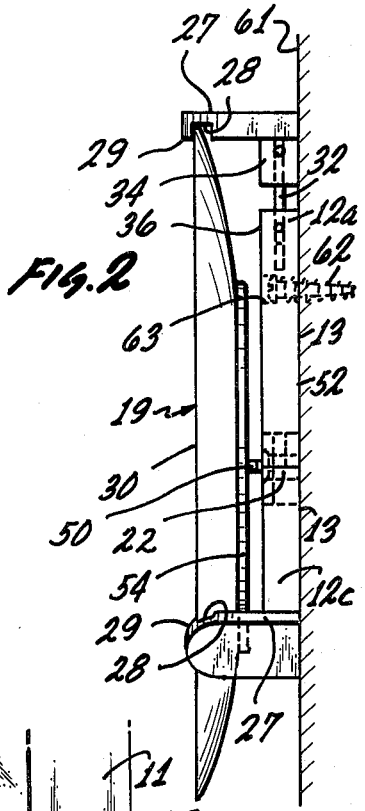
FIG. 2 is a side view of the plate holder of FIG. 1 affixed to a wall surface and showing a dish supported therein.
Figure 3:
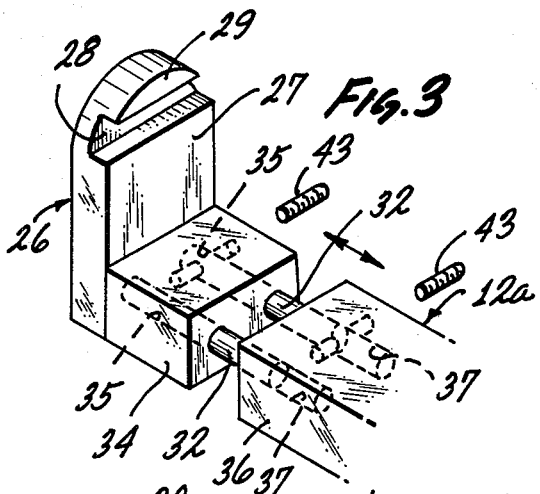
FIG. 3 is an enlarged fragmentary view showing one embodiment of the plate retainer of the holder.
Figure 6:
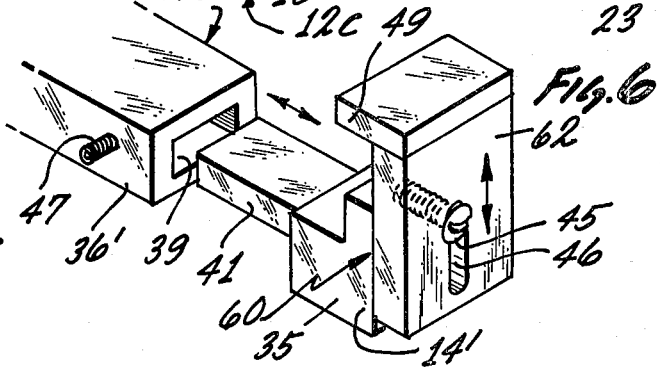
FIG. 6 is a fragmentary perspective showing an alternate embodiment of the plate retainer of FIG. 3.

The outer ends 14 of each arm 12*a, b, c,* are respectively provided with a plate retaining means illustrated in two different embodiments in FIGS. 3 and 6 and designated by the numerals 26 and 60 respectively. The plate retaining means comprises a first portion 27 extending frontally from the plane or structure defined by the arms 12*a, b, c,* and a second portion 29 extending radially inwardly over the rim 30 of a plate 19 shown in dotted lines in FIG. 1 and in solid lines in the side view of FIG. 2.

The vertical arm 12*a* in FIGS. 1 and 2 is constructed for variably extending the length of the arm. Parallel rods 32 slideably fit into bores 35 provided therefor in the outer segment 34 of arm 12*a* and aligned matching bores 37 are provided in inner segment 36 of the arm 12*a,* as best seen in FIG. 3. An adjusted length 12 is retained by set screws 43 clamping on rod 32 in members 36 and 34.

The plate retaining portion 29 in FIG. 3 is not forwardly adjustable with respect to the back plane for different plate depths. Instead,a threaded screw 50 is threaded into the back 52 of the planar or structure 10 inserted as a spacer and, it projects frontally therefrom to abutt against the bottom 54 of a plate 19 as seen in FIGS. 2 and 5, urging the plate against the radially inwardly extending portion 29 of the plate retaining means 26. The screw 50, therefore, functions as a central or inner plane-retaining means cooperating with the peripherally provided, overhung rim portions 29 which act as center-retaining means. Preferably the spacer screw 50 is threaded coaxially through the fastener screw 22 through a coaxial bore 23 thereof. The screw 50 is adjustable against a plate 19 from the back 52 of the plate holder with the aid of a miniature screw drive or hex wrench. The plate holder 10 is provided with means for affixing the planar structure directly to a wall surface 61 as in FIG. 2, such as screw 62 extending through a bore 63 formed in the vertical arm 12*a.* It will be seen that the back plane 52 defined by the flat rear surfaces 13 of arms 12*a, b,* and *c* of the plate holder 10 lies flat directly against the wall surface 61 without necessity of auxiliary spacer means, and screw 62 fastened the invention in that position in the wall.

FIG. 6 illustrates a modification in arm structure. The arm 12*a*′ has an inner segment 36′ provided with a bore 39 of rectangular cross-section to slidingly receive a square rod 41 affixed to outer segment 35 of arm 12*a*′. A set screw 47 is threaded into the inner segment 36′ in FIG. 6 to lock the square rod 41 in a selected position within bore 39 by bearing against the rod 41 within the bore 39. Similar set screws 43 are used in the embodiment of FIG. 3 to lock the parallel rods 32 within the bores 35 and 37 for selectively adjusting the length of the segmented arm 12*a.*

The plate is retained as per FIG. 6 using plate retaining elements 60 which include radially inwardly extending portions 49. Portions 49 are adjustable with respect to the planar structure defined by arms 12*a, b, c,* for adjusting the plate holder 10 to plates of different depths. The plate retaining element 60 is thus affixed to outer end 14′ of arm 12*a*′, by a screw 45 passing through a slot 46 formed in the frontally extending portion 62 such that the plate retaining element may be adjusted by tightening the screw 45 at a selected point along slot 46. In the embodiment of FIG. 6 all of the remaining arms are also provided with similarly adjustable plate retaining elements 60 making unnecessary the spacer screw 50.

The radial structure is assembled by bringing together the inner ends 15 of arms 12*a*, 12*b*, and 12*c*, as shown in FIG. 4. Arm 12*b* has tab member 20' extending midway from the end face, 18 while arms 12*a* and 12*c* have their respective tab members 20 and 20" extending from the end faces 18 flush with the front surface 11 and the rear flat surface 13, respectively.

The tab members are of similar dimensions and are stacked one over the other in sequence from front surface 11 to rear surface 13 to form the compact joint of FIG. 5. Tab 20' is placed over tab 20" so that free side 21*a* of arm 12*b* abuts end face 18 of arm 12*c* and free side 21*b* of tab 20" abuts end face 18 of arm 12*b*. At this stage of assembly the arms 12*b* and 12*c* are fixed at a given angle to each other, the specific angle being determined by the geometry of the tab members 20' and 20". For equilateral triangular tab members, the arms are fixed at a 120° angle.

Arm 12*a* is then joined by placing tab 20 over tab 20' so that free side 21*a* abuts end face 18 of arm 12*b* and free side 21*b* abuts end face 18 of arm 12*c*, tab 20 with attached arm 12*a* thus being fixed between the end faces 18 of the remaining unattached arms, 12*b* and 12*c*. It will be seen from the above description in conjunction with the drawings, particularly FIG. 4 thereof, that the free sides of each tab member 20, 20', 20" are fixed at a given angle by the end faces 18 of the remaining unattached arms.

Once the arms 12*a*, 12*b*, 12*c* have been assembled into the planar structure of FIG. 1 the arms are retained in fixed cooperative relationship by screwing the retaining screw 20 into the threaded central bore defined by aligned tab apertures 24*a*, 24*b* and 24*c*. The plate spacer screw 50 may then be threaded into the coaxial bore 23 of screw 20.

A plate 19 is mounted in the holder 10 of FIGS. 1 and 2 by first radially extending outwardly the plate retaining element 26 to a radial length in excess of the radius of the plate. The plate 19 is then inserted so that the rim 30 lies within the grooves 28 of arms 12*b* and 12*c*, and the plate retaining element 26 is moved radially inwardly until groove 28 thereof engages the plate rim 30. The spacer screw 50 is then advanced to abut against the bottom 54 of the plate 19 thus urging the rim 30 against the radially inwardly extending portions 29 of the arms 12*a*, 12*b*, 12*c* at which point the plate 18 is firmly supported within the plate holder 10.

The plate holder 10 is secured to a wall surface 61 by removing the plate 19 after again extending the adjustable plate retaining element 26 of arm 12*a* without disturbing the setting of spacer screw 50; and then screwing or nailing the plate holder 10 to a wall 61 as by a screw 62 passing through a bore 63 in the vertical arm 12*a*.

Plate 19 is then reinserted into the wall mounted holder 10 and the plate retaining element 26 is returned into engagement with the plate rim 30. The set screws 43 are now tightened to lock the plate retaining element 26 in engagement with the rim 30. At this point the plate 19 is securely retained at three points spaced 120° around rim 30 and is firmly held against the radially inwardly extending positions 29 by the spacer screw 50. With the plate retaining means of FIG. 6 the procedure is similar except that the portions 62 on each arm 12*a*, *b*, are adjusted for the depth of the particular dish, there being no central spacer screw 50.

Turning now to FIG. 7, a second embodiment of the invention is shown comprising a generally planar common center member 70 interconnecting a plurality of radial arms 72*a*, *b*, *c*. Each arm 72*a*, *b*, *c*, extends frontally of said center member 70 and is provided with grooves 74 defining on each arm a radially inwardly extending portion 76 for retaining a plate against the central member 70. Each arm 72*a*, *b*, *c*, also has a flat rear surface 73 which is retained by the center member 70 in a common back plane.

The vertical arm 72*a* in FIG. 7, shown in cross-section in FIG. 8, is connected to the center member 70 by means of a smooth radially extending rod 78 which is received within a bore 80 formed in arm 72*a*, such that the arm is slideably disengageable from the rod 78 in a radial direction. The remaining arms 72*b* and 72*c* are interconnected to the center member 70 by rods 79 provided with threads 81 engageable within corresponding threaded bores 83 formed in the central member 70, as best shown in FIG. 9. The arms 72*b* and 72*c* may, therefore, be variably screwed into the central member 70 for variably extending the length of the arms for accomodating plates of various diameters.

The center member 70 is preferably provided with a frontally projecting spacer such as an adjustable screw 85 being threaded therethrough for abutting against the bottoom of a plate, for urging the plate against portion 76 within groove 74 of the arms 72*a*, *b*, and *c*.

The plate retaining head of each arm 72(*a*, *b*, and *c*) includes a groove 74 and a radially inwardly extending portion 76 which engages the rim 91 of plate 90 for securing the plate within the plate holder. It will be apparent that the radial distance of arm 72*a* is adjustable to relation to the center member 70 independently thereof.

As shown in the sequence of FIGS. 10 and 11, arm 72*a* is disengageable from the radial structure to permit insertion of the plate 90 into the grooves 74 of the remaining arms 72*b* and 72*c*. After engagement of the plate 90 with radially inwardly extending portion 76 of arms 72(*b*) and (*c*), the arm 72(*a*) is reengaged with the planar structure 71 by slideably receiving the rod 78. The screw 85 is then advanced against the bottom of the plate to urge the plate 90 against portions 76 thereby firmly supporting the plate within the holder.

A bore 77 is formed in the center member 70 for receiving a screw or nail 99 for fastening the plate holder to a wall surface, so that the flat back plane defined by flat arm surfaces 73 lies flat directly against a plane wall surface.

Various changes and modifications may be made to the plate holders described above by those skilled in the art without departing from the spirit and scope of the present invention. Applicant therefore wishes to be bound only by the claims which follow.

What is claimed is:

1. An ornamental plate holder, comprising:

a plurality of arms, each having an outer end and an inner end, and at least one particular flat surface;

means connected to said inner ends for joining said arms in a planar radial structure at fixed angles so that said arms extend at said fixed angles, thereby retaining said flat surfaces in a common back plane, there being a common center;

outer plate-retaining means affixed to said outer ends, extending forward from said back plane and constructed for engaging the rim of the plate;

adjustagle spacer and inner plate-retaining means extending axially from the means for joining for engaging a plate centrally and from the rear and holding the plate tightly as adjusted and in cooperation with said outer plate-retaining means; and means for adjusting a radial distance of one of the retaining means in relation to said center and independently from the means for joining.

2. The holder of claim 1, wherein said means for joining further comprise:

tab member connected to each of said inner ends, said tab members being of complementary shape and cooperating to join said arms; and, fastener means maintaining said tab members in cooperative relationship.

3. The holder of claim 1 or 2 further comprising means for variably extending the length of at least one said arm.

4. The holder of claim 1 or 2 wherein said planar structure has a front and a back and said retaining means have portions extending radially inwardly over the rim of a plate for retaining the plate against said front of said planar structure.

5. The holder of claim 1 wherein said spacer and inner plate-retaining means is a screw threaded into the back of said planar structure said screw being adjustable for abutting against the bottom of a plate for urging the plate into engagement with said radially inwardly extending portions of said retaining means.

6. The holder of claims 1 or 2 further comprising means for variably spacing said plate retaining means with respect to the planar structure to thereby adjust the plate holder for plates of different depths.

7. The holder of claim 1 or 2 wherein each of said retaining means is affixed to one of said outer ends by a screw passing through a slot formed in said retaining means whereby said retaining means may be adjusted by tightening said screw at a selected point along said slot.

8. The holder of claim 1 or 2 wherein at least one of said arms further comprises an inner segment and an outer segment, one of said segments having formed therin a bore adapted to slidingly receive a rod attached to the other of said segments; and locking means for locking said rod in a selected position within said bore.

9. The holder of claim 8 wherein said locking means is a set screw threaded into said one of said segments and bearing against said rod within said bore.

10. The holder of claim 2 wherein said fastener is a first screw member threaded through said cooperating tab members.

11. The holder of claim 10 further comprising a second screw member generally coaxial with said first screw member and projecting frontally from said planar structure for adjustably supporting a plate against said retaining means.

12. The holder of claim 2 wherein said fastener means is a first screw passing through said tab members and perpendicular to said planar structure and further comprising a second screw generally coaxial with said first screw and projecting frontally from said planar structure for urging a plate against radially inwardly extending portions provided on said plate retaining means.

13. The holder of claim 1 or 2 wherein said arms are symmetrically spaced from one another.

14. The holder of claim 2 wherein said arms are of rectangular cross-section and terminate at said inner end in a rectangular end face and said tab members are generally planar equilateral geometric figures of reduced thickness relative to said arms and have a number of sides equal to the number of said plurality of arms, each tab member being attached to said end face of one of said arms in staggered manner relative to one another such that said tab members may be stacked in a predetermined sequence to form a substantially solid joint with each free side of each tab member abutting the end face of one of the remaining non-attached arms.

15. The holder of claim 1 further comprising means for affixing said planar structure to a wall surface.

16. The holder of claim 15 wherein said means for affixing comprise a bore formed in one of said arms for receiving a screw.

17. The holder of claim 4 wherein said radially inwardly extending portions of said plate retaining means are made of optically transparent material so that the rim portions engaged thereby are exposed to view.

18. The holder of claim 2 wherein said arms, said tab members, and said plate retaining means are made of a transparent plastic.

19. The holder of claim 1 wherein said means for joining said arms comprises a generally planar central member interconnecting said arms;

said plate retaining means further comprising radially inwardly extending portions for retaining a plate against said central member; and One of said arms being disengageable from said central member for insertion of the plate in the holder and reengageable with said central member after engagement of said plate with the radially inwardly extending portions of the remaining arms thereby securing the plate within said holder.

20. The holder of claim 19 further comprising a plurality of radial rods connecting said arms to said central member, said disengageable arm having a bore for receiving one of said rods and being slideably disengageable therefrom in a radial direction.

21. The holder of claims 19 and 20 further comprising means for variably extending the length of at least one said arm.

22. The holder of claim 21 wherein said means for variably extending comprise thread means on said rods engageable within a threaded bore formed in said central member whereby said rod may be variably screwed into said central member.

23. The holder of claim 21 wherein said means for variably extending comprise thread means on at least one of said rods engageable with a threaded bore formed in said least one arm.

24. The holder of claim 21 wherein said space or means is an adjustable screw threaded through said central member for a buffing against the bottom of a plate.

25. The holder of claims 1 or 2 or 19 wherein said plurality of arms comprises 3 arms symmetrically spaced at 120° intervals.

* * * * *